United States Patent [19]

Ewing

[11] Patent Number: 5,042,092

[45] Date of Patent: Aug. 27, 1991

[54] GARMENT

[76] Inventor: Elizabeth Ewing, 70 Lefurgy Ave., Hastings-on-Hudson, N.Y. 10706

[21] Appl. No.: 297,363

[22] Filed: Jan. 18, 1989

[51] Int. Cl.[5] ..... A41B 9/00; A41B 9/08; A41D 1/22

[52] U.S. Cl. ..... 2/400; 2/67; 2/70; 2/71; 2/73; 2/109; 2/408

[58] Field of Search ..... 2/67, 70, 71, 73, 77, 2/109, 212, 400, 408; 450/120

[56] References Cited

U.S. PATENT DOCUMENTS

| | | | |
|---|---|---|---|
| 1,993,568 | 3/1935 | Rosenberg | 2/71 |
| 2,018,665 | 10/1935 | Flesh | 2/77 |
| 2,018,666 | 10/1935 | Flesh | 2/77 |
| 2,060,689 | 11/1936 | Read | 2/67 |
| 2,443,474 | 6/1948 | Morgan | 2/67 |
| 2,561,783 | 7/1951 | Burr | 2/406 X |
| 3,068,488 | 12/1962 | Rodriguez | 2/212 |
| 3,243,824 | 4/1966 | Overholt | 2/67 X |
| 3,712,308 | 1/1973 | Herbener | 2/408 |

*Primary Examiner*—Werner H. Schroeder
*Assistant Examiner*—Jeanette E. Chapman
*Attorney, Agent, or Firm*—Paul J. Sutton

[57] ABSTRACT

The present invention teaches a one-piece garment which is capable of being worn either alone or over panty hose, underpants, tights, or the like, as well as being worn under pants, slacks, a dress and/or a skirt and a blouse, and which permits performing one or more bodily or hygienic functions without the need to remove any of same.

15 Claims, 4 Drawing Sheets

FIG. 1
PRIOR ART
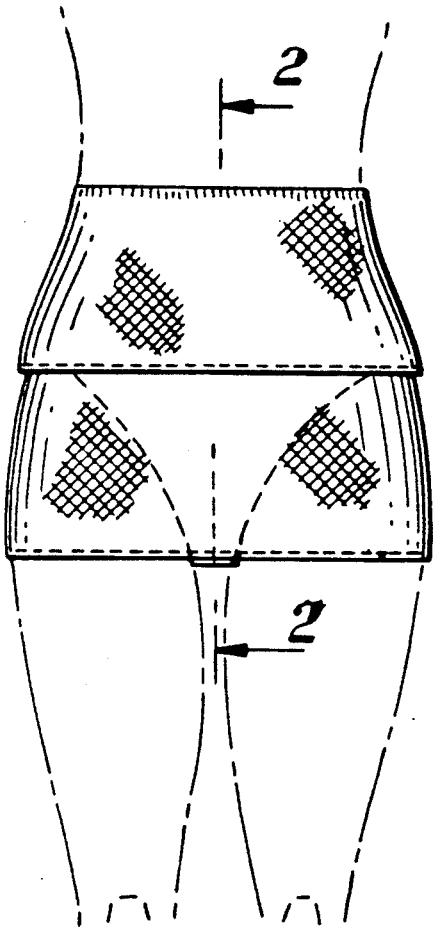
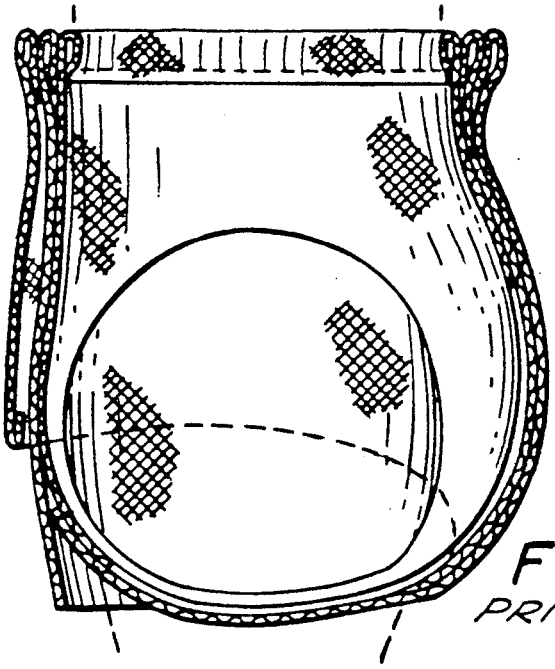
FIG. 2
PRIOR ART
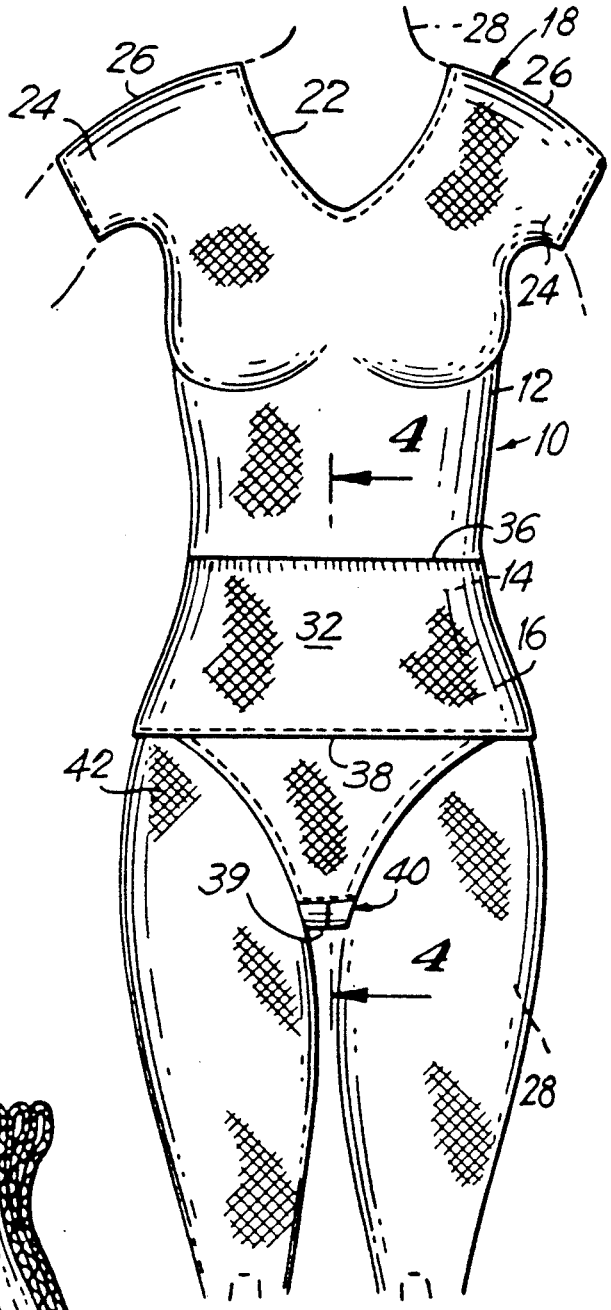
FIG. 3

FIG. 8
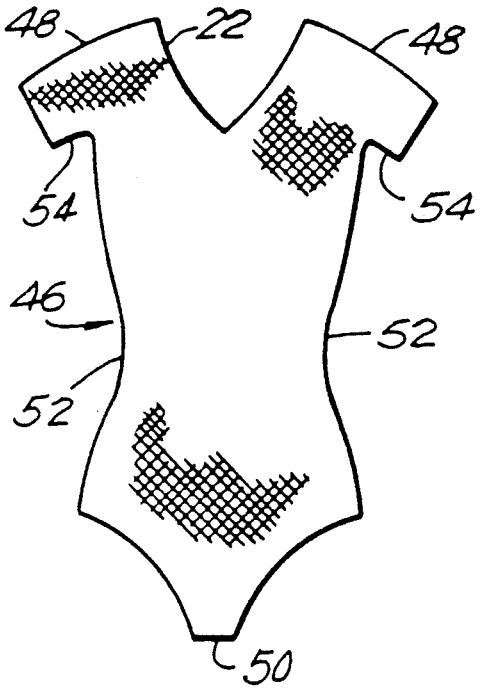
FIG. 9
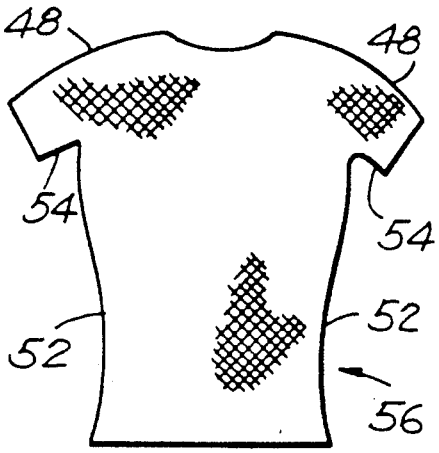
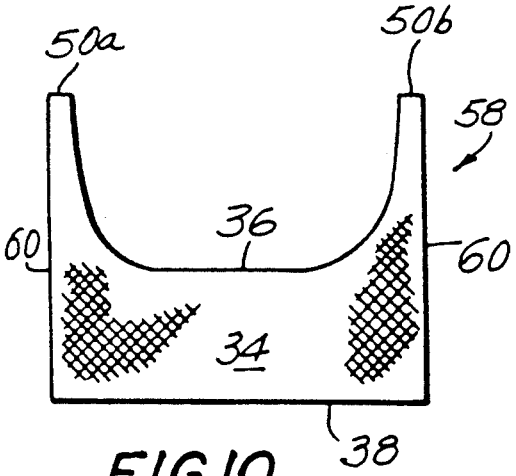
FIG.10
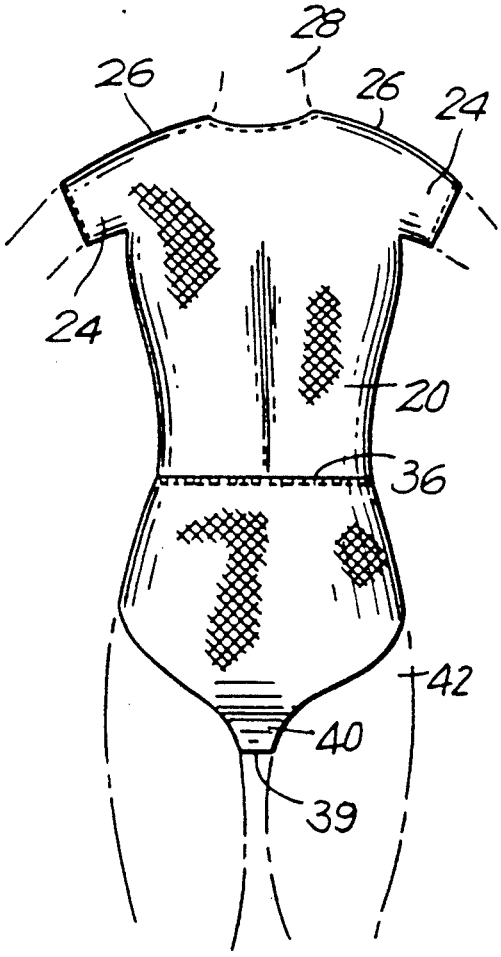
FIG. 11

GARMENT

The present invention relates qenerally to garments, and more particularly to a novel one-piece garment which permits performing one or more bodily or hygienic functions without the need to remove clothing worn underneath and/or over same.

A need has existed for a solution to a problem experienced by women who wear leotards, leotard-type bodysuits or the like, over clothing such as, without limitation, pantyhose, panties or underpants, tights, etc.. The female reader of the present specification will perhaps better than the male reader appreciate and recall those uncomfortable instances when it has been necessary or desirable to perform bodily functions while wearing a leotard or other type of close fitting garment over tights, by way of example only. The term "bodily functions", as used herein, shall include, without limitation, urinating, defecating, applying or replacing a tampon or sanitary pad or other menstrual protection, or performing any other type of hygienic procedure where access to the body's crotch area is necessary or desirable.

Thus, picture the active woman who is attending an exercise class and, while wearing a leotard over tights, has to go to the bathroom. Presently, she is required to remove the leotard from at least the part of the body above the waist, if not entirely, in order to pull the crotch area of the leotard down far enough, and then lower the tights, pantyhose and/or panties to permit the woman to sit upon a toilet. If the woman is wearing any kind of a garment over the shoulders, this garment must first be removed. In either case, the entire part of the body above the waist is exposed in this instance. If the woman is wearing a dress, skirt and blouse, pants and blouse or sweater, tedious, inconvenient removal of all such garments is now the case—often in tight quarters which may not be clean and which may not include provisions for hanging or holding the clothing removed.

The example a woman weearing a leotard over tights or pantyhose is given here because many women do so in order to minimize or eliminate the normal sagging of the tights or pantyhose crotch area which, apart from causing discomfort, looks less attractive, and requires privacy to adjust, and eventually restricts the normal leg motion associated with stair-climbing, for example. Many women also wear the leotard- all day as normal part of their wardrobe, making one of the problems solved by this invention all the more critical.

Prior patent art known to me as a result of a preliminary patentability search includes the following: U.S. Design Pat. No. Des. 239,667 granted on Apr. 27, 1976 to Bouchard; U.S. Pat. Nos. 2,018,665 and 2,018,666 granted on Oct. 29, 1935 to Flesh; U.S. Pat. No. 2,060,689 granted on Nov. 10, 1936 to Read; U.S. Pat. No. 2,443,474 granted on June 15, 1948 to Morgan; U.S. Pat. No. 2,561,783 granted on July 24, 1951 to Burr; U.S. Rodriguez; U.S. Pat. No. 3,777,764 granted on Dec. 11, 1973 to Herbener: and U.S. Pat. No. 3,243,824 granted to Overholt on Apr. 5, 1966.

None of the prior art patents listed above, whether taken singly or in any combination with one another, solves the aforementioned problems or anticipates or, for that matter, includes the structural and functional features of the present invention. Indeed, none of these patents even attempt to solve the aforementioned problems and, as such, each is unable to fulfill the objects of the present invention.

Of the patents listed above, perhaps the best example of a prior art garment which, while worn to cover similar body parts, and which simply cannot be used in accordance with the present invention, is Rodriguez U.S. Pat. No. 3,068,488. I have taken the trouble and incurred the expense of constructing a garment in accordance with the Rodriguez disclosure, in order to confirm and dramatize the problems inherent in the prior art. I have included in the drawings forming part of this application a depiction of the Rodriguez garment (a description of Rodriguez is included in the part of this specification below, which refers specifically to the figures of the drawings).

It is an object of the present invention to overcome the aforesaid limitations and to provide a combination of cooperative elements in the form of a garment which is capable of being worn over tights, pantyhose, underpants or panties, etc..

Another object of the present invention is to provide such garment which is constructed of elastic material in a one-piece configuration.

A further object of this invention is to provide such a garment which may be worn as a leotard, bathing suit, exercise or dance body suit, or simply as casual wear.

Yet another object of the present invention is to provide such a garment, which offers complete freedom for the wearer to perform the bodily functions described above, by exposing the entire crotch area of the body for such hygienic purposes.

Still a further object of the present invention is to provide such a garment which eliminates the need to remove garments which are worn under and/or over the garment of the present invention.

Another object is to provide such a garment, which may be manipulated without assistance to what I will refer here to as a "loosened" (lowered) position or state by physically healthy or impaired or handicapped wearers including, without limitation, totally or partially blind, arthritic, cerebral palsy, or neurologically affected people whose deficits in gross and/or fine motor skills make undressing and dressing more of a challenge.

Still another object of this invention is to provide such a garment which is characterized by the absence of any kind of fasteners such as hooks, loops, buttons, or velcro, to name a few, which makes possible the foregoing benefit to the handicapped.

Yet a further object of the present invention is to provide such a garment which is attractive and which provides the wearer with abdominal support.

In a preferred embodiment of the present invention, a close-fitting one-piece elastic garment is provided which is capable of being worn over pantyhose, tights or the like, and which includes an upper garment portion including (in a fitted, not lowered, position) upper and lower annular ring portions thereof which, respectively, cover body parts above and below the waist, a lower garment portion comprising an annular web portion formed with a wall member which extends between upper and lower annular edges, a crotch portion extending from the upper (posterior) annular edge of said wall member to the lower (anterior) annular ring portion of said upper garment portion, said garment being capable of repeated manipulation between fitted and loosened states, said loosened (lowered) state facilitating the wearer's attending to unobstructed bodily functions without the need to remove either said garment or hose worn beneath said garment.

Stated differently, a close-fitting one-piece garment is provided which is capable of being worn over pantyhose, tights, or the like, and which includes an upper garment portion which is supported by and covers at least a portion of the upper body of the wearer, a lower abdominal section extending downwardly from the upper garment portion to cover at least a portion of the lower abdomen of the wearer, a waistband portion adapted to encircle the waist of the wearer, and a crotch portion extending from the lower abdominal section to the posterior section of the waistband to snugly cover the crotch area of the wearer when in the fitted position. The waistband is capable of being pulled down together with the crotch portion and any underlying pantyhose, tights, or the like in order to completely expose the buttocks and crotch area of the wearer for unobstructed performance of hygenic bodily functions without any need for disturbing the upper garment portion of the garment.

Further objects of the present invention and its features will suggest themselves to those skilled in the art upon a reading of the present specification, together with the drawings annexed hereto wherein throughout the several views, similar reference characters denote similar elements, and wherein:

FIG. 1 is an front elevational view of a garment constructed according to the disclosure of prior art U.S. Pat. No. 3,068,488 to Rodriguez, illustrated upon a body shown fragmentarily in phantom outline;

FIG. 2 is a sectional elevation view taken along the line 2—2 of FIG. 1;

FIG. 3 is a from elevational view of a garment according to the present invention, illustrated upon a body shown fragmentarily in phantom outline;

FIG. 8 is a plan view of a front panel pattern according to the present invention;

FIG. 9 is a plan view of a rear panel pattern according to the present invention;

FIG. 10 is a plan view of a panty area pattern according to the present invention; and FIG. 11 is a rear elevational view of the garment of the present invention as it would be viewed upon the wearer, and in a form created by the joiner of the patterns illustrated in FIGS. 8–10, inclusive.

Figure 4:
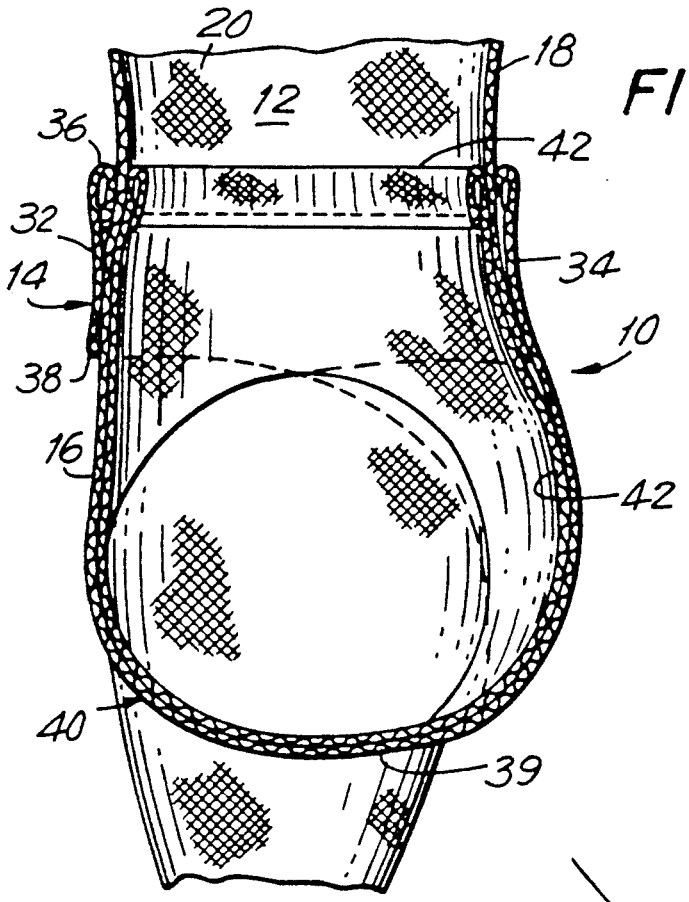
FIG. 4 is a sectional elevation view taken along the line 4—4 of FIG. 3.

Referring now in more detail to the drawings, FIG. 1 illustrates in an elevational view a prior art. garment taught by Rodriguez U.S. Pat. No. 3,068,488. As has been stated above, the views of Rodriguez shown in FIG. 1 are not duplicates of the patent drawings, but rather are drawings made from an actual model of the Rodriguez garment produced by me based upon the patent's drawings, and worn by me in a manner which would demonstrate to me its capability, or incapability, to perform the functions sought to be performed by the present invention. I found that it was incapable of performing the required and desired functions which are capable of being performed by the garment of the present invention.

Unlike my garment, which will be described in more detail below, the Rodriguez garment includes as an integral part thereof inner "panties with an open crotch" which lies within an outer "pantie-like skirt" (column 1, lines 47–63). In the drawings hereof, reference character 101 has been assigned to the Rodriquez garment, and wherein the panties with an open crotch is 103 and the pantie-like skirt is 105 (best seen in FIGS. 1, 2 and 5).

Figure 5:
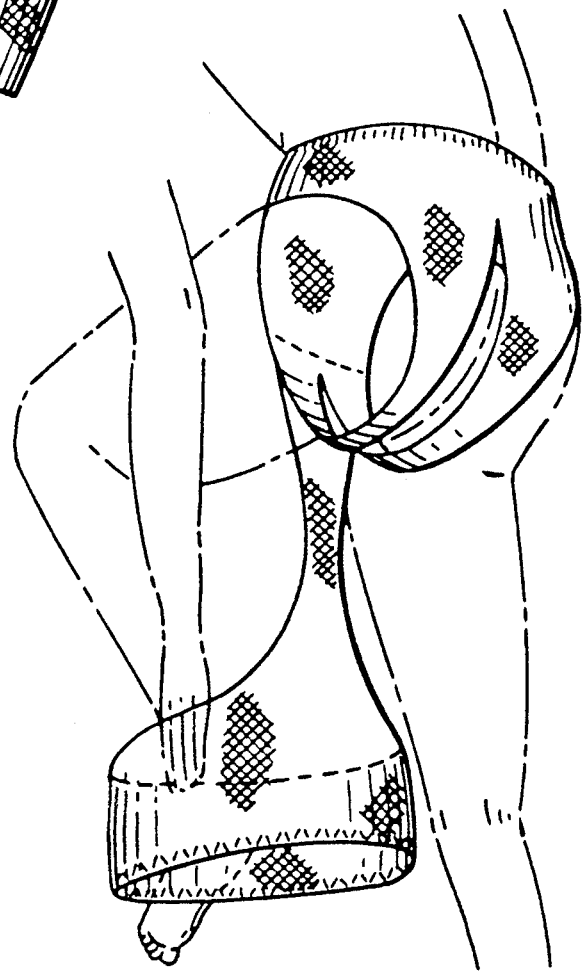
FIG. 5 PRIOR ART
FIG. 5 is a view of the prior art garment of FIG. 1, illustrated upon a phantom outline body figure depicted donning the garment.

FIG. 5 most dramatically illustrates the areas of the buttocks and crotch which are covered by the Rodriguez garment, leaving but a narrow and grossly inadequate open crotch area available to the wearer for performing bodily functions. I have found that two hands are required merely to separate the edges of the adjacent garment areas in order to gain access to body privates. One would need another (third) hand, incredible dexterity, and excess room in order to apply or replace menstrual protection with this prior art structure. The very need in Rodriguez to provide a panty as a necessary part of the structure makes this garment impractical and impossible to use in accordance with the present invention. The Rodriguez panty is meant to be able to underlay a girdle 107 (FIG. 2), while the skirt is meant to overlay the girdle. As will be understood, the garment according to the present invention is not meant to constitute a panty, per se, but rather be able to be capable of being worn over a complete panty, if desired.

FIG. 3 illustrates garment 10 of the present invention which preferably consists of a one-piece or unitary structure of elastic material comprising an upper garment portion 12 having what I will refer to here as upper and lower annular ring portions (abdominal sections) 14 and 16, respectively. Portions 14 and 16 are preferably simply adjacent areas of garment 10 which cover portions of the abdominal area just above and below the waist and may be in the form of adjacent annular ring portions as shown in FIG. 3. Upper abdominal section or portion 14 has been given a separate designation from its lower counterpart in order to dramatize its covering of body parts above the waist, as opposed to below the waist and, in this regard, this invention contemplates any number of different top configurations, either of elastic or non-elastic material, without departing from the intended spirit and scope of the invention. As shown in FIG. 3, a top 18 may simply include a torso tube 20 terminating at its upper extremities in a V-neck 22, short sleeves 24, and shoulders 26 which serve as tension anchors against which the elastic material making up garment 10 is able to pull, thereby keeping the garment in desired tension and up and in a proper position on the body 28.

It will be appreciated by those skilled in the art that top 18 alternatively may have a sleeveless, backless or even strapless configuration within the spirit and scope of the present invention. It will also be appreciated that upper and lower abdominal sections or portions 14 and 16 may be cut away to expose the back and/or sides of the wearer as well as having the full annular ring configuration shown in FIG. 3.

Garment 10 further includes a lower garment portion 30, itself including an annular web (waistband) portion 32 in the form of an annular web including a wall 34 which, in turn, extends between upper and lower annular edges 36 and 38, respectively. A crotch portion 40 extends at a relatively wider width from the posterior section 37 of waistband portion 32 to a comparable width at lower annular ring portion (abdominal section) 16, the intermediate portion thereof being progressively narrow to a midsection 39 and thereafter progressively wider.

Garment 10, when worn in a fitted position or state, such as illustrated in FIG. 3, functions as a leotard, although it is contemplated that it may function as a body suit, a bathing suit, dance outfit, exercise garment, and others that are obvious. In FIG. 3, garment 10 is illustrated worn over pantyhose 42 which includes fabric covering the legs, crotch and up to the waist. Abdominal support is provided by the presence of the wall 34 of annular web (waistband) portion 32, which overlays lower annular ring portion (abdominal section) 16 which itself overlays the portions of the pantyhose overlaying the wearer's lower abdomen (FIGS. 3 and 4).

Figure 6:
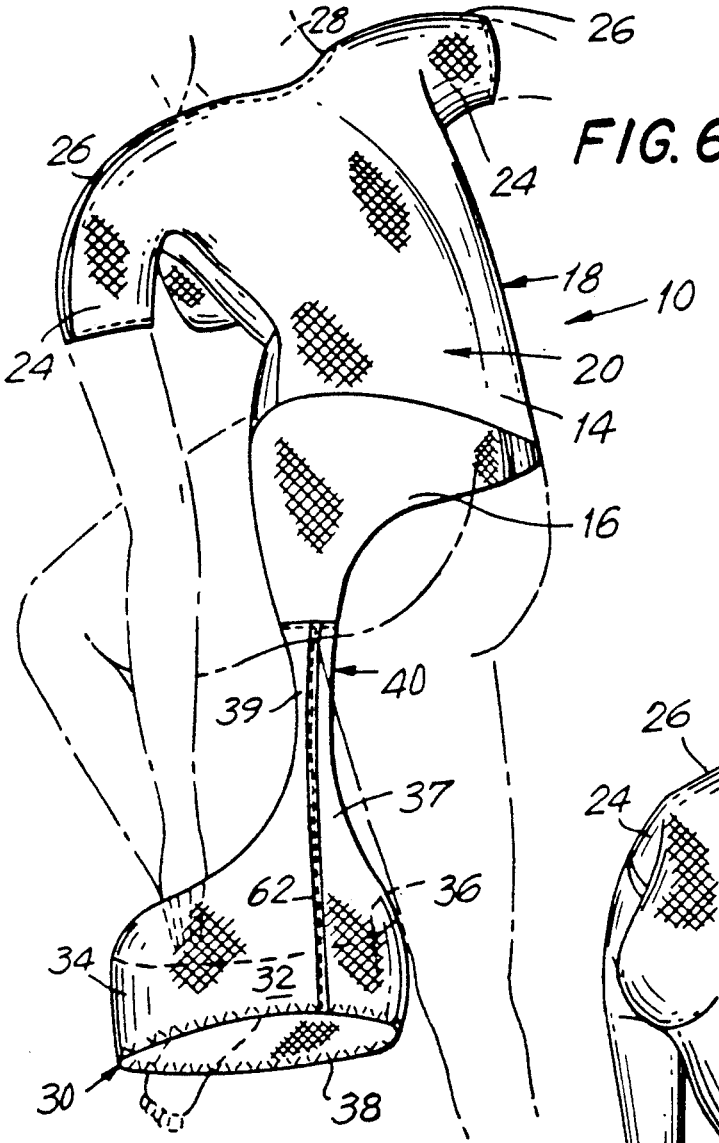
FIG. 6 is a view of the garment of FIG. 3, illustrated upon a phantom outline body figure depicting donning the garment.

In use, the wearer is able first to slide the top 18 over her head and over the shoulders and torso, with the crotch portion 40 suspended therefrom, as shown in FIG. 6. The wearer thereupon simply places each foot into the opening formed by annular web (waistband) portion 32 and its wall 34, and pulls upper annular edge 36 upwardly until it assumes the fitted position shown in FIG. 3. In so doing, the wearer or user has necessarily drawn the crotch portion 40 of garment 10 into a fitted position over and against the pantyhose material covering the user's crotch, with a resulting form fit about the user's body.

With garment 10 in this fitted state, the user is free to move the body in any desired way, consistent with the activity being performed—whether it be exercising, dancing, walking, sitting, stretching, etc.. However, the benfits of my invention are most apparent when the user wishes to perform hygienic and/or bathroom functions.

Figure 7:
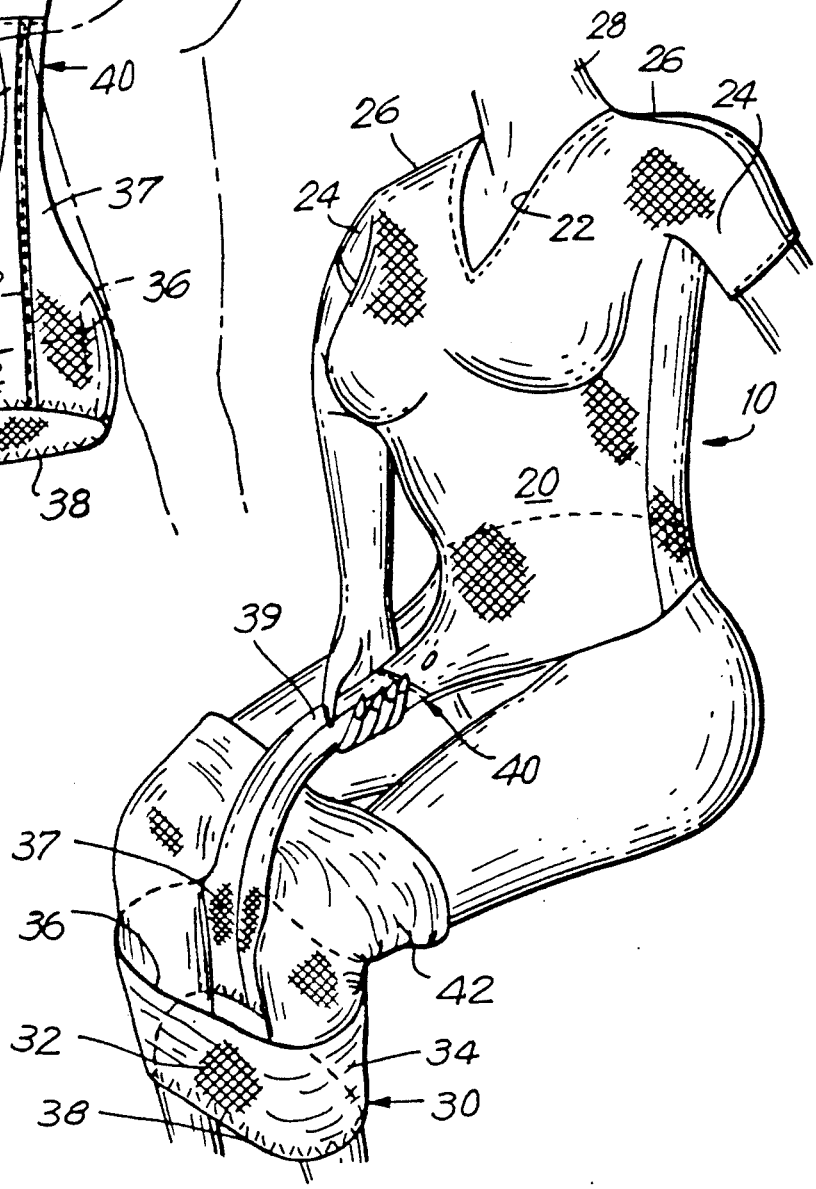
FIG. 7 is a partial fragmentary left perspective view of the garment according to the present invention, illustrated upon a phantom outline body figure depicted performing a bodily function.

By pulling down the lower annular edge 38 of annular web (waistband) portion 32, wall 34 slides down easily to the calves, for example (see FIG. 7), and the pantyhose 42 is free to likewise be drawn free of the user's entire crotch area to a position just above the knees, for example. In this "loosened" (lowered) position or state illustrated in FIG. 7, the user or wearer is able to very easily perform one or more of the aforementioned bodily functions essentially in much the same manner as if she were not wearing any clothing or garments. The configuration of crotch portion 40 is such that the user may optionally, but not necessarily, hold same as shown in the drawings, or pull same upwardly or to either side for better visibility, if desired. Again, even this crotch portion 40 is entirely free of the user's crotch area and in no way causes interference or obstruction. For lack of a better phrase, I have used the term "manipulation" to define the adjusting movement of garment 10 from its fitted to its loosened (lowered) states.

Clearly, when the user is finished performing the above bodily functions, the pantyhose 42 is easily raised to its original fitted postion, and the annular web portion and its associated crotch portion are returned to their respective fitted positions. The reader will appreciate now that there is no need to remove any garment in order t complete the foregoing manipulation. Furthermore, should the user be wearing pants over her tights, and a blouse or sweater with or without a jacket—again, neon of these garments need be removed in order to easily and effectively perform one or more of said bodily functions.

FIGS. 8–10 have been presented as one of the preferred, but certainly not the only, embodiments of fabric patterns which, when joined, will constitute or make up the garment 10 according to the present invention. A front panel 46 is shown extending from upper shoulder edges 48 to a central crotch edge 50. Therebetween, side edges 52 extend upwardly to outwardly extending sleeve edges 54.

In FIG. 9, like reference characters have been assigned to edges of the rear panel 56 illustrated therein, in order to more easily indicate those edges whose like reference characters are to be joined by sewing or other attachment means. FIG. 10 illustrates a crotch or panty area panel 58 whose side edges 60 are joined to form a seam 62 visible in FIG. 6 of the drawings. The upper edges **50*a* and 50*b* of panel 58 are joined to edge 50 of the front panel 46 (FIG. 8), in order to define crotch portion 40**.

It must again be emphasized here that the particular examples of the invention herein set forth and described are merely that—examples—and it is contemplated that the present invention will include other shapes, forms and structures which accomplish the same ends in substantially the same manner.

It should now also be obvious to the reader that the Rodriguez garment does not permit the wearing of a sanitary menstrual pad either by adherance to the slit crotch or by the wearing of underpants under the Rodriguez garment. If underpants were worn, the purpose of the slit crotch would be negated because access to the crotch through the crotch slit would be obstructed. Moreover, the presence of the panty material covering the buttocks in the Rodriguez garment makes it virtually impossible to draw down tights or pantyhose worn underneath this prior art garment.

The embodiments of the invention disclosed and described in the present specification and drawings and claims are presented merely as examples of the invention. Other embodiments, forms and modifications thereof will suggest themselves from a reading thereof and are contemplated as coming within the scope of the present invention.

What is claimed is:

10 garment
12 upper garment portion
14 upper annular ring portion
16 lower annular ring portion
18 top
20 torso tube
22 V-neck
24 short sleeves
26 shoulders
28 body
30 lower garment portion
32 annular web portion
34 wall
36 upper annular edge
37 posterior section (of 32)
38 lower annular edge
39 medsection (of 40)
40 crotch portion
42 pantyhose
44 -----
46 front panel
48 shoulder edges
50 crotch edge 50*a* upper edge (of 58)
50*b* upper edge (of 58)
52 side edges
54 sleeve edges
56 rear panel
58 crotch (panty) area panel
60 side edges
62 seam

1. A garment which is capable of being worn over one or more optional undergarments such as underpants, tights, pantyhose, or the like, comprising, in combination:

an upper garment portion including upper and lower annular ring portions which, respectively, cover body parts above and below the area of the wearer's naval, said lower annular ring portion being capable of covering at least from or rearward body parts below said area of the wearer's naval, a lower garment portion comprising an annular lower web portion formed with a lower wall member which extends between upper and lower annular edges of said lower garment portion lower wall member, said annular lower web portion wall member including front and a rearward portions thereof which, respectively, overlie said front or rearward body parts below said area of the wearer's naval, a crotch portion extending from said rearward portion of said lower wall member to the lower annular ring portion of said upper garment portion, said garment being capable of repeated manipulation between fitted and loosened states, said loosened state facilitating the wearer's removal of said lower wall member and any optional undergarments work beneath said garment from said front or rearward body parts below the area of the wearer's naval to a position below the thighs, thereby exposing sufficient portions of the crotch area to permit the wearer's attending to crotch area bodily functions without the need to remove entirely from the wearer's legs below the thighs either said argument or optional undergarments worn beneath said garment.

2. The garment, according to claim 1, wherein said upper and lower garment portions comprise a one-piece structure of elastic material.

3. A garment, according to claim 1, wherein said upper and lower garment portions extend from shoulder to crotch.

4. A garment, according to claim 1, wherein said garment comprises a leotard-type bodysuit.

5. A garment, according to claim 1, wherein said garment comprises a bathing suit.

6. A garment, according to claim 1, wherein said garment is characterized by the absence of a need for fasteners and hardware, thereby permitting functioning and manipulation by the handicapped who wear same.

7. A garment, according to claim 1, wherein said annular web provides the user with abdominal support.

8. A garment, according to claim 1, wherein said crotch portion draws against the crotch of the user hose or other garments worn underneath the garment.

9. A relatively close-fitting substantially one-piece garment which is capable of being worn over pantyhose, or the like, comprising:

an upper garment portion adapted to be supported by the upper body of the wearer, a lower abdominal section extending downwardly from said upper garment portion to cover at least a portion of the lower abdominal area of the wearer, a waistband portion adapted to encircle the waist of the wearer and overlie said lower abdominal section, said waistband portion having a posterior section adapted to cover the lower spinal area of the wearer, and a crotch portion extending from said lower abdominal section to said posterior section to relatively snugly cover the crotch area of the wearer, said waistband portion being capable of being pulled down together with said crotch portion to completely expose the buttocks and crotch area of the wearer for unobstructed performance of hygienic bodily functions without disturbing said upper garment portion.

10. A garment according to claim 9, wherein said garment comprises a one-piece structure of elastic material.

11. A garment according to claim 10, in combination with pantyhose, tights or the like, said garment being worn over said pantyhose, tights or the like such that said waistband portion is capable of being pulled down together with said pantyhose, tights or the like to completely expose the buttocks and crotch area of the wearer for unobstructed performance of hygienic bodily functions without disturbing said upper garment portion.

12. A garment according to claim 10, wherein said upper garment includes an upper annular ring portion adapted to encircle the body of the wearer above the waist.

13. A garment according to claim 9, wherein said upper garment portion extends over the shoulders of the wearer.

14. A garment according to claim 12, wherein said abdominal section comprises a lower annular ring portion adapted to encircle the body of the wearer below the

15. A garment according to claim 14, wherein said waistband portion comprises an annular web adapted to overly said lower annular ring portion.

* * * * *